US006089350A

United States Patent [19]

Hankins

[11] Patent Number: 6,089,350

[45] Date of Patent: Jul. 18, 2000

[54] LADDER SAFETY ANCHOR DEVICE

[76] Inventor: Eddie Wm. Hankins, 910 Manor Rd., Independence, Mo. 64055

[21] Appl. No.: 09/225,288

[22] Filed: Jan. 4, 1999

Related U.S. Application Data

[60] Provisional application No. 60/075,315, Feb. 20, 1998.

[51] Int. Cl.[7] ..... E06C 5/00

[52] U.S. Cl. ..... 182/107; 182/129

[58] Field of Search ..... 182/107, 129; 52/156, 158, 155, 162, 164

[56] References Cited

U.S. PATENT DOCUMENTS

| | | |
|---|---|---|
| 214,217 | 4/1879 | Webster . |
| 316,573 | 4/1885 | Rockwood . |
| 1,393,808 | 10/1921 | Melvin . |
| 2,523,535 | 9/1950 | Little . |
| 4,039,047 | 8/1977 | Larson et al. . |
| 4,576,250 | 3/1986 | Marish . |
| 4,669,576 | 6/1987 | Jones et al. . |
| 5,154,255 | 10/1992 | Kiska et al. . |
| 5,222,575 | 6/1993 | Santos . |
| 5,337,856 | 8/1994 | Fillers . |
| 5,499,691 | 3/1996 | Fitzpatrick . |
| 5,669,462 | 9/1997 | Jennings . |
| 5,678,656 | 10/1997 | Lanzafame . |

*Primary Examiner*—Alvin Chin-Shue
*Attorney, Agent, or Firm*—Tipton L. Randall

[57] ABSTRACT

A device for anchoring an upright inclined ladder to prevent movement of the ladder away from an object is disclosed. The ladder anchor hooks around the lowest rung of the ladder and contains a wedge shaped portion that penetrates the ground between the ladder and the object the ladder rests against.

18 Claims, 7 Drawing Sheets

LADDER SAFETY ANCHOR DEVICE

CROSS REFERENCE TO RELATED APPLICATION

This application claims the benefit under 35 U.S.C. §119 (e) of co-pending provisional application Serial No. 60/075,315, filed Feb. 20, 1998. Application Serial No. 60/075,315 is hereby incorporated by reference.

FIELD OF THE INVENTION

The invention relates to a safety device for free standing ladders, and more particularly to an adjustable length safety anchor that is positioned between the ladder and the object against which the ladder is placed.

BACKGROUND OF THE INVENTION

Free standing ladders find use for gaining access to the roofs of buildings, for painting the sides of structures, as well as providing a portable means of access to a variety of elevated locations. Each year a number of individuals are injured in falls from a ladder. Many times the fall is caused by the ladder failing to remain stationary as the person climbs toward the top thereof Often, the user has failed to make certain that the lower end of the ladder is prevented from shifting or sliding away from the object against which the ladder is placed.

It is common practice to provide some sort of stabilization for the lower end of a ladder in order to prevent falls and other mishaps. Some examples of innovative devices for securing the lower end of an upright, inclined ladder are shown in the following patents.

Larson et al., in U.S. Pat. No. 4,038,047, shows a ladder pivot foot with ground spikes. Larger wedges that clip to the foot of a ladder are disclosed by Marish in U.S. Pat. No. 4,576,250, and by Jones et al. in U.S. Pat. No. 4,669,255. Fitzpatrick, in U.S. Pat. No. 5,499,691, describes an emergency breaking system using large spikes that attach to the rungs of a ladder, while in U.S. Pat. No. 5,6669,462 Jennings discloses a ladder leveling apparatus with multiple spikes to hold the ladder against slippage.

These innovative devices concentrate upon anchoring the inclined ladder bottom end to the surface directly at the base of the ladder, or a point in the surface opposite the object against which the ladder is placed. Many times there are situations where these devices cannot function as intended, such as where the base of the ladder rests on an impervious surface, such as concrete, blacktop or paving stone. Thus, there is an unmet need for a ladder anchor device that can maintain the base of an inclined ladder in a stable position on these and other surfaces.

SUMMARY OF THE INVENTION

The present invention is a device for anchoring an upright inclined ladder with top end resting against an object and bottom end resting on a support surface, to prevent movement of the ladder bottom end away from the object. The anchor device includes a generally rectangular base member. A hook member has a first hook portion for encircling a ladder bottom rung, and a second shank portion attached perpendicularly to a first side of the base member. A tubular member is fastened at a first end perpendicularly to a second side of the base member and extends in opposition to the hook member fastened thereto. A surface penetrating member is secured to a second end of the tubular member for insertion into a surface supporting the ladder, thereby preventing the ladder bottom end from moving away from an object contacting the top end of the ladder. Also disclosed is a climbing which includes a ladder member and the above described anchor device.

DESCRIPTION OF THE PREFERRED EMBODIMENTS

Nomenclature

Figure 1:
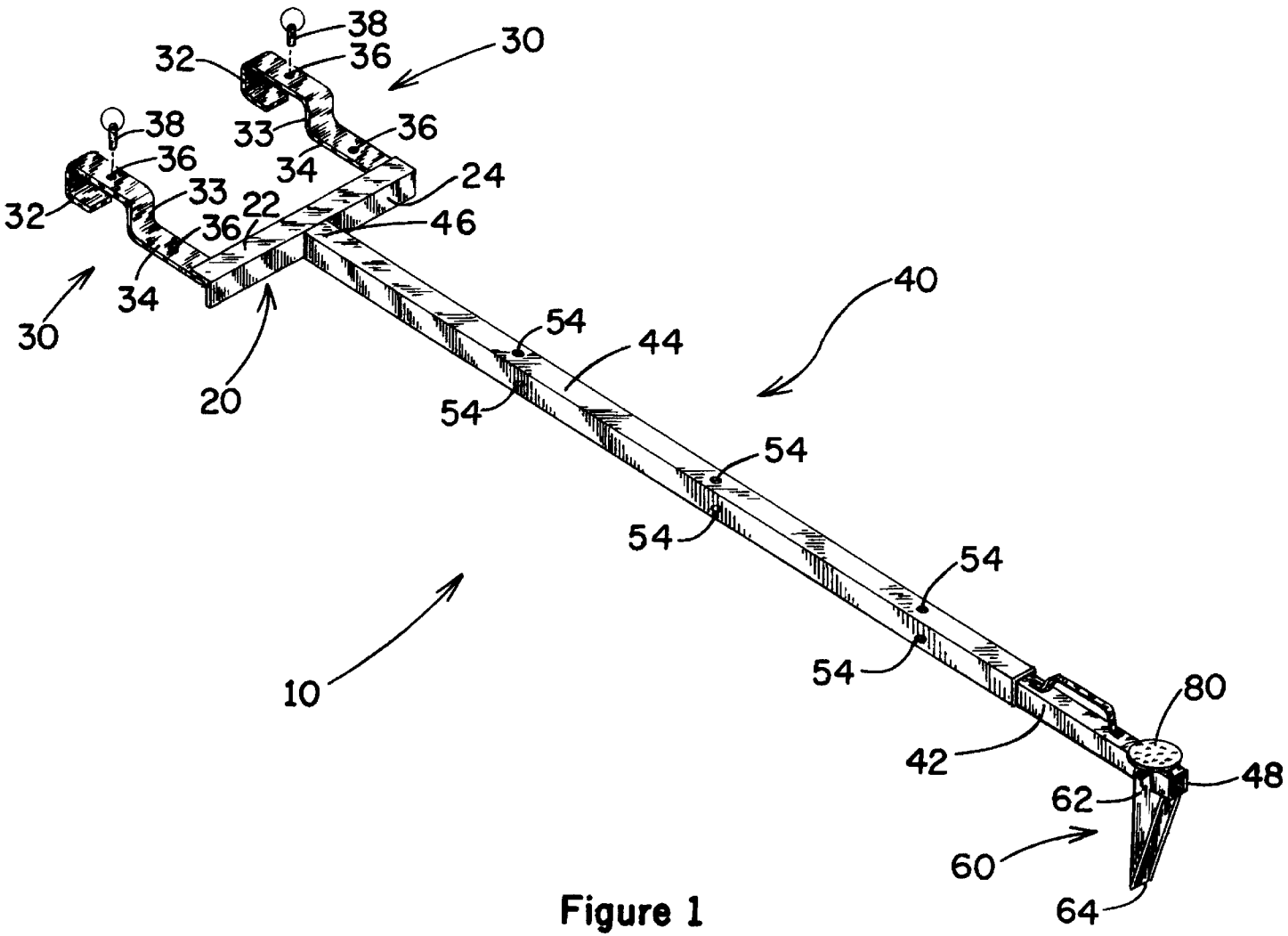
FIG. 1 is an perspective plan view of the ladder anchor of the present invention.
Figure 2:
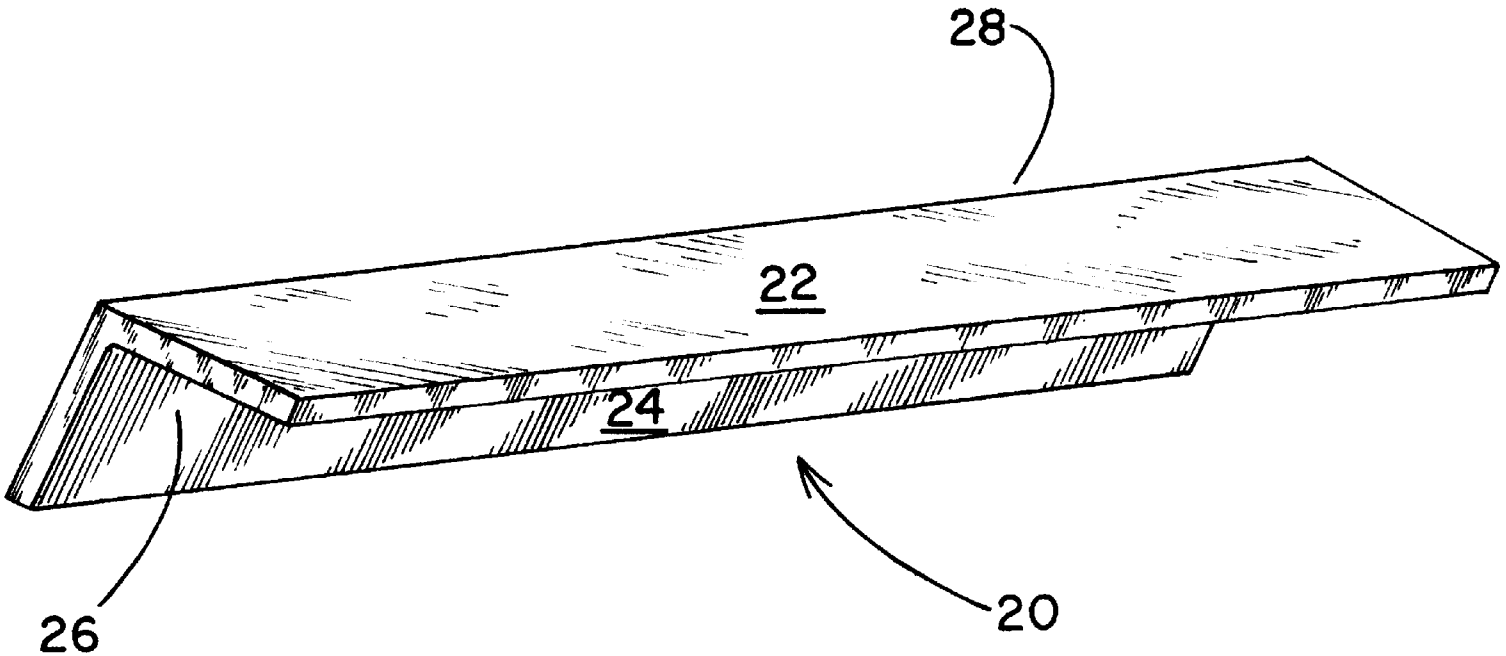
FIG. 2 is a perspective view of the rectangular base member of the device.

10 Ladder Anchor Member
20 Rectangular Base Member
22 Angle Iron Section
24 Angle Iron Section
26 Angle Iron Inner Side
28 Angle Iron Outer Side
30 Hook Member
32 Hook Member Hook End
33 Hook Member Center Bent Section
34 Hook Member Shank End
36 Hook Member Aperture
38 Hook Member Fastener
40 Telescoping Tubular Member
42 Inner Tubular Section
44 Outer Tubular Section
46 Tubular Member First End
48 Tubular Member Second End
52 Tube Section Adjusting Fasteners
54 Tube Section Apertures
60 Surface Penetrating Member
62 Penetrating Member Blunt End
64 Penetrating Member Pointed End
66 Penetrating Member Side Portion
68 Penetrating Member Apertures
70 Tubular Member Second End Apertures
72 Penetrating Member Fastener
75 Stop Member for Penetrating Member
80 Foot Pad Member
90 Ladder Fastening Clip Member
100 Ladder Member
105 Ladder Lowest Rung Member
110 Ladder Member Top End
115 Ladder Member Bottom End
S Support Surface
B Building Construction Referring to FIG. 1, the ladder anchor member 10 is shown in perspective view. The ladder anchor member 10 includes a generally rectangular base member 20, that is preferably a short length of angle iron, with mutually perpendicular sections 22, 24, thereby providing an inner side 26 and an outer side 28 of the base member as shown in FIG. 2. A hook member 30 for encircling the lowest rung member 105 of a ladder member 100 is attached to the base member 20. In the preferred embodiment, two hook members 30, each having a hook end 32 and a shank end 34, are fastened at the shank end 32 to the angle iron in spaced apart relationship. It is convenient to fasten the shank end 34 of each hook member 30 to the inner side 26 of one section 22 of the angle iron member. Thus, the hook members 30 extend parallel to the section 22 of the angle iron to which the members 30 are attached, and perpendicular to the other section 24 of the angle iron. To further ensure that the hook members 30 remain securely attached to the ladder lowest rung member 105, each hook member 30 has an aperture 36 near the hook end 32 that reversibly accepts a fastener 38. The fastener 38 may be a bolt, a push pin or the like, with the fastener 38 locking the hook member 30 around the ladder rung member 105. A second aperture 36 near the shank end 34 of each hook member 30 may be present for conveniently storing the fasteners 38 when not in use for locking the hook members 30 around the ladder rung member 105.

In the preferred embodiment of the invention, the hook members 30 each have a center bent section 33 that directs the hook shank end 34 toward the support surface S with the hook end 32 encircling the ladder lowest rung member 105. The function of the hook center bent section 33 is to allow the rectangular base member 20, attached to the hook shank end 34, to rest near or upon the support surface S.

Figure 3:
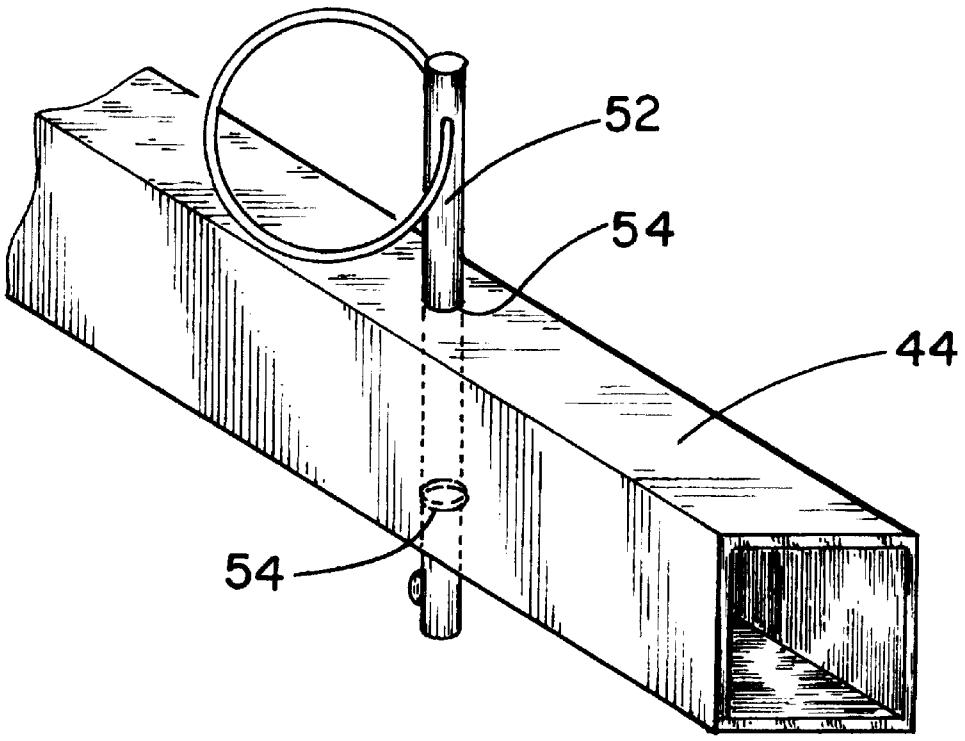
FIG. 3 is a perspective partial view of the tube section adjusting fasteners.

Although the tubular member 40 may be of unitary construction, it is preferred that the tubular member 40 be of telescoping construction. Preferably, a telescoping tubular member 40, composed of an inner tubular section 42 and an outer tubular section 44, is fastened at a first end 46 to the outer side 28 of the side portion 24 of the base member 20, such that the tubular member 40 extends in opposition to the two hook members 30 also attached thereto. A second end 48 of the tubular member 40 carries a surface penetrating member 60 described in detail later. As shown in FIG. 3, the tubular member 40 is telescopically adjustable by means of removable fasteners; 52, such as bolts or pins, that are inserted through a plurality of matching apertures 54 in the inner tubular section 42 and the outer tubular section 44. The apertures 54 are spaced and aligned such that the length of the telescoping tubular member 40 is adjustable by extending the concentric components 42, 44 a desired distance, aligning the apertures 54 there through, and inserting one or more removable fasteners 52 through the aligned apertures 54. While the tubular member 40 is shown with the outer tubular section 44 fastened to the base member 20, and the surface penetrating member 60 secured to the inner tubular member 42, the inner and outer tubular sections may be interchanged with equivalent function for the ladder anchor member 10. Likewise, the inner and outer tubular sections of the tubular member 40 are shown as having rectangular cross section. Other cross, sections, such as circular, triangular or the like, are contemplated, without impairing the function of the tubular member 40.

Figure 4:
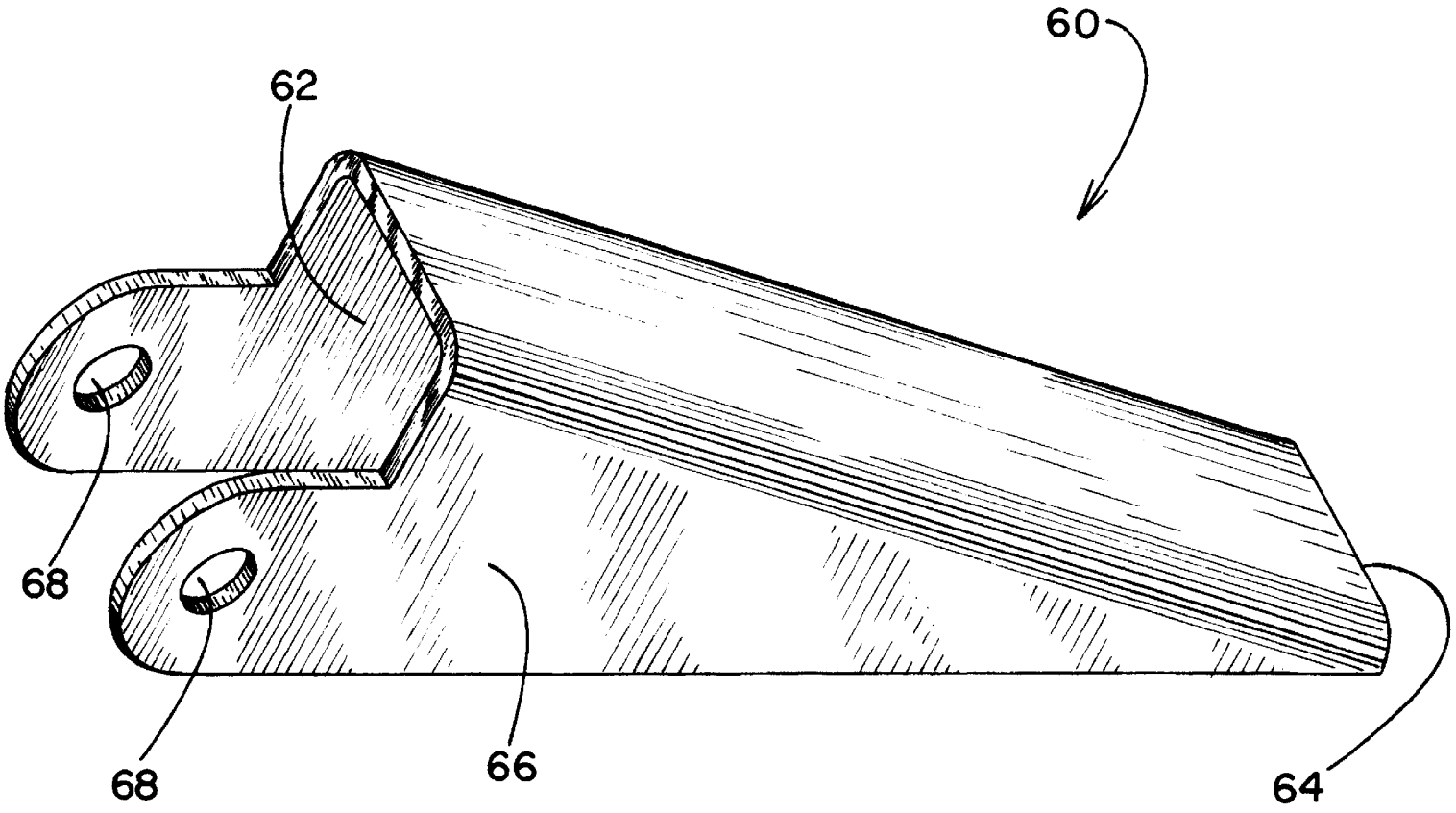
FIG. 4 is a perspective plan view of the surface penetrating member of the device.
Figure 5:
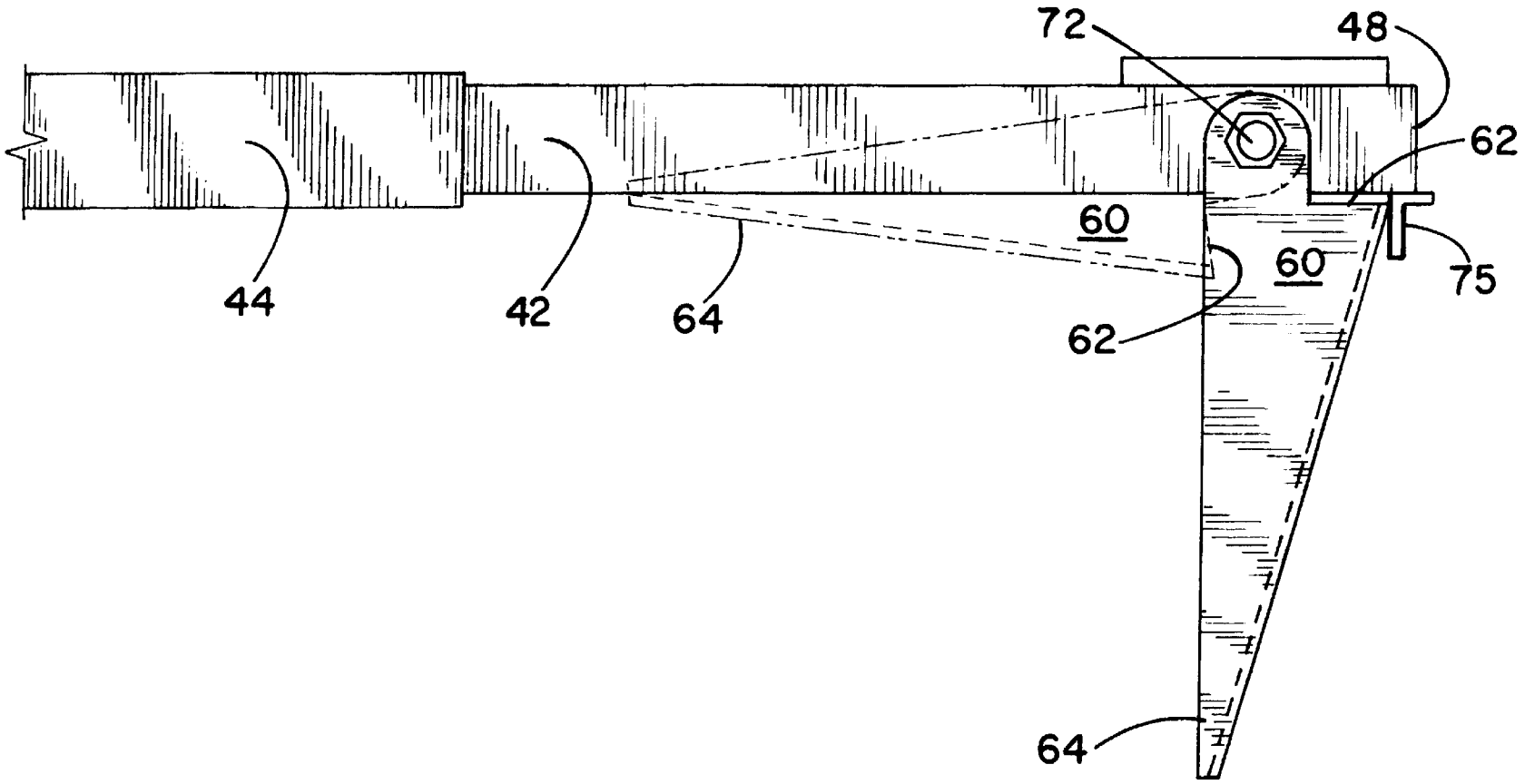
FIG. 5 is a side plan view of the surface penetrating member pivotally attached to the tubular member of the device.

As mentioned above, the second end 48 of the tubular member 40 carries a surface penetrating member 60 shown in FIG. 4. The penetrating member 60 is preferably a wedge-shaped device having a U-shaped cross section. The penetrating member 60 has a blunt end 62 that is fastened to the tubular member second end 48, and a pointed end 64 opposite the blunt end 62. The penetrating member 60 is sized to accept the tubular member second end 48 within the U-shaped blunt end 62. The wedge member side portions 66 each have apertures 68 near the blunt end 62. The apertures 68 match a pair of apertures 70 (see FIG. 6) in the tubular member second end 48. A fastener 72, such as a bolt with nut or a push pin inserted through apertures 68 and 70, secures the wedge shaped penetrating member 60 to the tubular member second 48. The penetrating member 60 may be permanently secured in a perpendicular orientation relative to the tubular member second end 48. However, it is preferred that the penetrating member 60 be pivotally fastened to the tubular member second end 48, as seen in FIG. 5. In this embodiment, the blunt end 62 of the penetrating member 60 is prevented from pivoting beyond perpendicular by contact of the blunt end 62 transverse portion with the tubular member second end 48. The U-shaped wedge member 60 is sized such that it can pivot about the fastener 70 to bring the pointed end 64 tightly against the tubular member second end 48. Optionally, a stop member 75 may be fastened to the tubular member second end 48 to further prevent the U-shaped wedge member 60 from pivoting beyond perpendicular. Thus, the penetrating member 60 can be pivoted from an orientation essentially parallel to the telescoping tubular member 40 to an orientation perpendicular thereto, as shown in FIG. 5.

Figure 6:
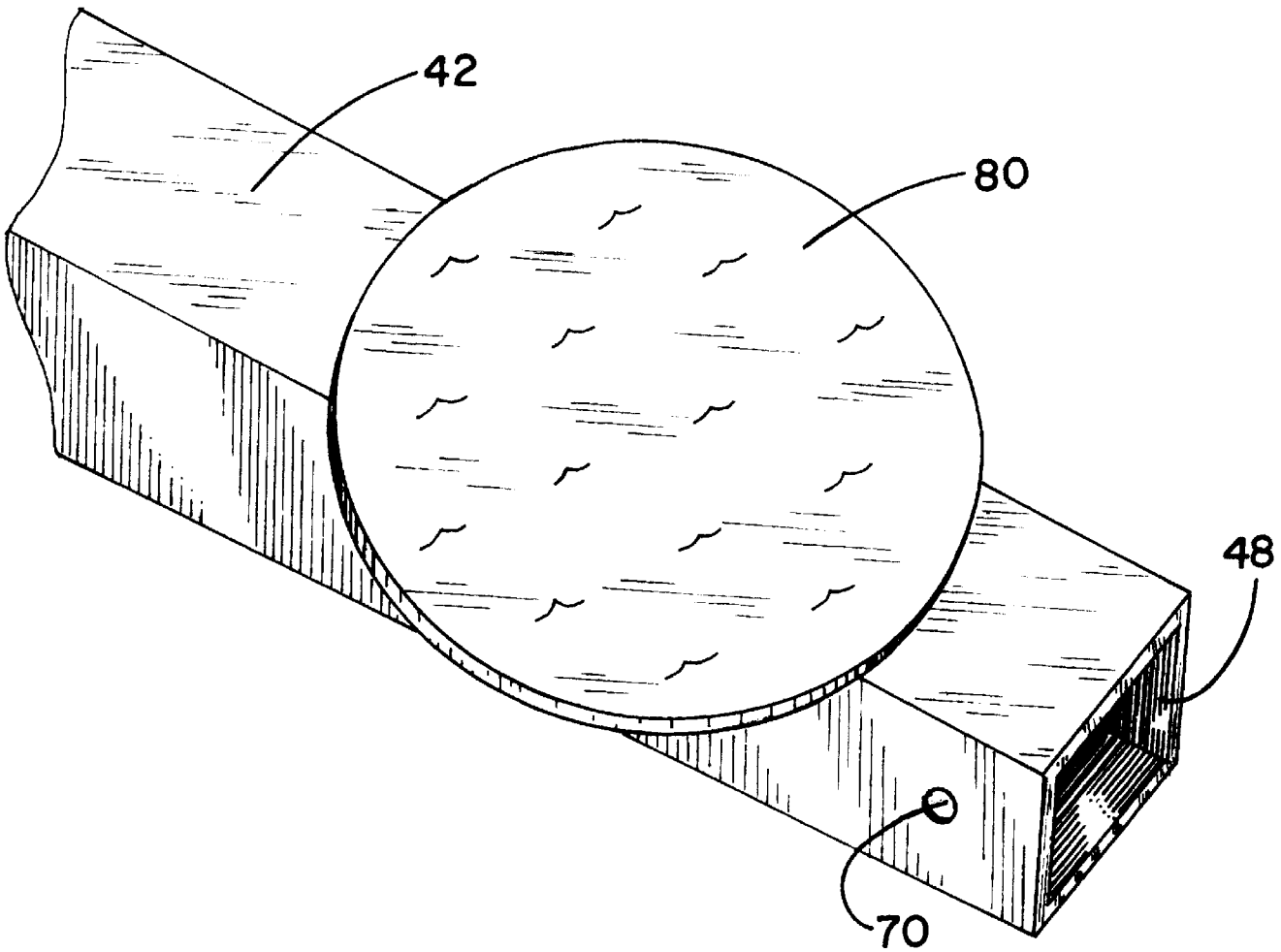
FIG. 6 is a perspective partial view of the foot pad member of the device.

Once the ladder anchor member 10 is in position, the wedge-shaped surface penetrating member 60 is driven into the surface S supporting the ladder member 100. It is preferred that a flat foot pad member 80 be secured to the top side of the telescoping tubular member 40 near the second end 48 thereof A user can drive the wedge-shaped member 60 into the support surface S by stepping upon the foot pad member 70 that is shown in FIG. 6.

Figure 7:
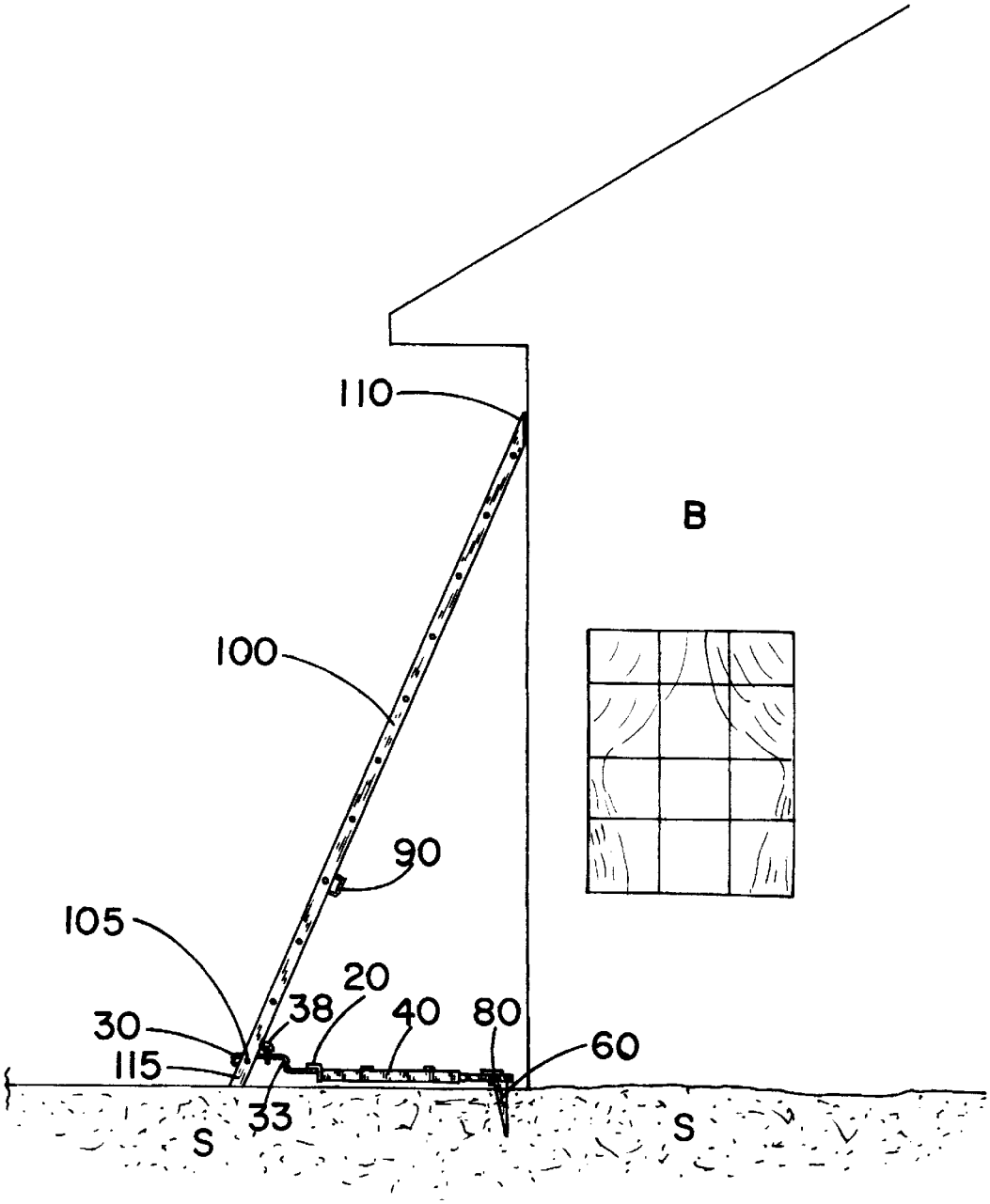
FIG. 7 is a side elevational view of the ladder anchor member attached to a ladder with the ladder resting against a building.

The ladder anchor member 10 is used with an upright inclined ladder member 100 with the ladder top end 110 resting against an object, such as a building B, and the ladder bottom end 115 resting on a support surface S. The anchor member 10 is secured to the lowest rung member 105 of the ladder member 100 by means of the hook members 30, with the anchor member 10 located between the ladder member 100 and the object the ladder is resting against. The surface penetrating member 60 is driven into the support surface S, thus preventing the bottom end 115 of the ladder member 100 from moving away from the object against which the ladder member 100 rests. The placement of the ladder anchor member 10 relative to the ladder member 100 and a building B is seen in FIG. 7. The position of the anchor member 10 does not interfere with an individual climbing up and down the ladder.

The ladder anchor member 10 of the present invention is particularly useful where there are obstructions near the bottom end 115 of the ladder, such as sidewalks, shrubbery or the like. The adjustable length telescoping tubular member 40 can extend the surface penetrating wedge member 60 a variable distance from the ladder bottom end 115 to overcome obstacles which might otherwise interfere with the anchoring of the ladder bottom end 115 to the support surface S.

When moving the ladder member 100 from one location to another, it is not necessary to remove the ladder anchor member 10 from the lowest ladder rung member 105. The wedge shaped penetrating member 60 is removed from the support surface S, and pivoted against the telescoping tubular member 40. The anchor member 10 is then pivoted about the encircled rung member 105 to rest against the under side of the ladder member 100. A fastening clip member 90, attached to an upper rung of the ladder member 100, secures the anchor member 10 against the ladder member 100 for transport with the ladder member 100. Alternatively, a hook member (not shown) may be fastened near the second end 48 of the tubular member 40. The hook member is used to secure the anchor member 10 against the ladder member 100 by fastening the hook member around one of the ladder rungs. When the ladder member 100 is repositioned, the above steps are performed in reverse order to anchor the ladder member 100 in a new location.

The ladder anchor member 10 may be fabricated from any material of suitable strength, including wood, plastic or metal. It is preferred that the anchor member 10 be fabricated from suitable aluminum stock so that it will be light weight and resist corrosion.

Also disclosed herein is a method of making the ladder anchoring device and a method of using that device. The method of making the ladder anchor device comprises obtaining a generally rectangular base member. A hook member, having a first hook portion for encircling a ladder bottom rung and a second shank portion, is attached perpendicularly to a first side of the base member. A telescoping tubular member, having inner and outer tubular sections, is fastened at a first end perpendicularly to a second side of the base member and extends in opposition to the hook member fastened to the base member. The inner and outer tubular sections each are provided with a plurality of apertures positioned so as to align with the telescoping tubular member extended to variable lengths. Fasteners for inserting through the apertures for maintaining the telescoping arm member at a selected length are provided. And lastly, a surface penetrating member is secured to a second end of the telescoping tubular member for insertion into a surface supporting the ladder.

A method to prevent movement of an upright ladder foot end away from an object comprises providing a ladder anchor device that includes a generally rectangular base member. A hook member has a first hook portion for encircling a ladder bottom rung and a second shank portion attached perpendicularly to a first side of the base member. A telescoping tubular member with inner and outer tubular sections is fastened perpendicularly at a first end to a second side of the base member and extends in opposition to the hook member fastened thereto. The inner and outer tubular sections have a plurality of apertures positioned so as to align with the telescoping tubular member extended to variable lengths. There are fasteners for inserting through the apertures for maintaining the telescoping tubular member at a selected length. A surface penetrating member is secured to a second end of the telescoping tubular member. The ladder anchor device is attached to an upright ladder by encircling the ladder bottom rung with the hook member, and the device is positioned between the ladder and the object against which the ladder rests. The surface penetrating member is inserted into the surface supporting the ladder, thereby preventing the ladder foot end from moving away from the object contacting the top end of the ladder.

While the invention has been particularly shown and described with reference to a preferred embodiment thereof, it will be understood by those skilled in the art that various changes in form and details may be made therein without departing from the spirit and scope of the invention.

I claim:

1. An anchoring device for securing an upright inclined ladder having rungs, the ladder top end resting against an object and ladder bottom end resting on a support surface, the device preventing movement of the ladder bottom end away from the object, the anchoring device comprising:

a) a generally linear base member;

b) two hook members each having a first hook portion adapted for encircling a ladder rung, and a first shank portion, said shank portion of each hook member attached perpendicularly to a first side of said linear base member in spaced apart relationship, c) a tubular member fastened at a first end perpendicularly to a second side of said linear base member between said spaced apart hook members, and extending in opposition to said two hook members fastened thereto;

d) a surface penetrating member secured to a second end of said tubular member for insertion into a surface, thereby preventing movement of said tubular member, said base member and said two hook members of said anchoring device; and e) a fastener member positioned in an aperture in said first hook portion of said hook member, said fastener member adapted for locking said hook member around a ladder rung.

2. The anchoring device according to claim 1, wherein said two hook members each have a center bent section for elevating said hook portion relative to said shank portion.

3. The anchoring device according to claim 1, wherein said tubular member is telescoping with inner and outer tubular sections, said sections having means for selectively adjusting the length of said telescoping tubular member.

4. The anchoring device according to claim 3, wherein said selective adjusting means comprises a plurality of apertures through said telescoping tubular member, said apertures positioned so as to align upon said telescoping tubular member extended to variable lengths, and fasteners for inserting through said apertures for maintaining said telescoping tubular member at a selected length.

5. The anchoring device according to claim 1, wherein said tubular member is rectangular in cross section.

6. The anchoring device according to claim 1, wherein said tubular member is circular in cross section.

7. The anchoring device according to claim 1, wherein said surface penetrating member secured to the second end of said tubular member is wedge shaped with a sharp end and a blunt end.

8. The anchoring device according to claim 7, wherein said surface penetrating member is pivotally secured at said blunt end to the second end of said tubular member.

9. The anchoring device according to claim 8, further comprising a stop member secured to said second end of said tubular member to maintain said wedge member perpendicular to said tubular member.

10. The anchoring device according to claim 1, further comprising a foot pad member secured to said second end of said tubular member, said foot pad member positioned in opposition to said surface penetrating member.

11. An anchoring device for securing an upright inclined ladder having rungs, the ladder top end resting against an object and ladder foot end resting on a support surface, the device preventing movement of the ladder foot end away from the object, the anchoring device comprising:

a) a generally linear base member;

b) two hook members each having a first hook portion adapted for encircling a ladder rung, and a first shank portion, said shank portion of each hook member attached perpendicularly to a first side of said linear base member in spaced apart relationship;

c) a telescoping tubular member with inner and outer tubular sections, said telescoping tubular member fastened at a first end perpendicularly to a second side of said linear base member between said spaced apart hook members, and extending in opposition to said hook members fastened thereto, said inner and outer tubular sections having means for selectively adjusting the length of said telescoping tubular member;

d) a surface penetrating member secured to a second end of said tubular member for insertion into a surface, thereby preventing movement of said telescoping tubular member, said base member and said two hook members of said anchoring device; and e) a fastener member positioned in an aperture in said first hook portion of said hook member, said fastener member adapted for locking said hook member around a ladder rung.

12. The anchoring device according to claim 11, further comprising a foot pad member secured to said second end of said telescoping tubular member, said foot pad member positioned in opposition to said surface penetrating member.

13. The anchoring device according to claim 11, wherein said surface penetrating member secured to said second end of said telescoping tubular member is wedge shaped with a sharp end and a blunt end, said wedge blunt end pivotally fastened thereto.

14. The anchoring device according to claim 13, further comprising a stop member secured to said second end of said telescoping tubular member to maintain said wedge member perpendicular to said telescoping tubular member.

15. A climbing assembly comprising:

(a) an upright ladder member having multiple rung members, said ladder member having top and bottom ends with rung members adjacent thereto, (b) an anchoring device comprising;

(i) a generally linear base member;

(ii) two hook members each having a first hook portion adapted for encircling a ladder rung, and a first shank portion, said shank portion of each hook member attached perpendicularly to a first side of said linear base member in spaced apart relationship, said first hook portions encircling a rung member adjacent said ladder member bottom end;

(iii) a telescoping tubular member with inner and outer tubular sections, said telescoping tubular member fastened at a first end perpendicularly to a second side of said linear base member and extending in opposition to said hook members fastened thereto, said inner and outer tubular sections having a plurality of apertures therein, said apertures positioned so as to align with said telescoping tubular member extended to variable lengths, with fasteners for inserting through said apertures for maintaining said telescoping arm member at a selected length;

(iv) a surface penetrating member secured to a second end of said telescoping tubular member for insertion into a surface supporting said ladder member, thereby preventing movement of said anchor device and said ladder member secured thereto; and (v) a fastener member positioned in an aperture in said first hook portion of said hook member, said first hook portion encircling a ladder rung member, said fastener member locking said hook member around said ladder rung member.

16. The anchoring device according to claim 15, further comprising a foot pad member secured to said second end of said telescoping tubular member, said foot pad member positioned in opposition to said surface penetrating member.

17. The anchoring device according to claim 15, wherein said surface penetrating member secured to said second end of said telescoping tubular member is wedge shaped with a sharp end and a blunt end said wedge blunt end pivotally fastened thereto.

18. The anchoring device according to claim 17, further comprising a stop member secured to said second end of said telescoping tubular member to maintain said wedge member perpendicular to said telescoping tubular member.

* * * * *